US009524817B2

(12) United States Patent
Kim et al.

(10) Patent No.: US 9,524,817 B2
(45) Date of Patent: Dec. 20, 2016

(54) METAL MAGNETIC POWDER AND METHOD FOR FORMING THE SAME, AND INDUCTOR MANUFACTURED USING THE METAL MAGNETIC POWDER

(71) Applicant: SAMSUNG ELECTRO-MECHANICS CO., LTD., Suwon (KR)

(72) Inventors: Hak Kwan Kim, Seoul (KR); Sung Yong An, Anyang (KR); Sung Jae Lee, Suwon (KR); Jung Wook Seo, Hwasung (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 118 days.

(21) Appl. No.: 14/048,825

(22) Filed: Oct. 8, 2013

(65) Prior Publication Data

US 2014/0375413 A1 Dec. 25, 2014

(30) Foreign Application Priority Data

Jun. 21, 2013 (KR) ..... 10-2013-0071603

(51) Int. Cl.

| | |
|---|---|
| ***H01F 27/24*** | (2006.01) |
| ***H01F 5/00*** | (2006.01) |
| ***H01F 27/28*** | (2006.01) |
| ***H01F 1/00*** | (2006.01) |
| ***H01F 1/26*** | (2006.01) |
| ***H01F 1/33*** | (2006.01) |
| ***H01F 17/00*** | (2006.01) |

(52) U.S. Cl.

CPC *H01F 1/26* (2013.01); *H01F 1/33* (2013.01); *H01F 17/0033* (2013.01)

(58) Field of Classification Search

CPC ..... H01F 5/00; H01F 27/28; H01F 1/00

USPC ... 336/200, 232, 233; 252/62.51 R, 62.51 C, 252/62.56

See application file for complete search history.

(56) References Cited

U.S. PATENT DOCUMENTS

| | | | | |
|---|---|---|---|---|
| 3,842,152 | A * | 10/1974 | Witfield, Jr. et al. | 264/210.2 |
| 5,966,065 | A * | 10/1999 | Onizuka | C04B 35/26 252/62.56 |
| 2009/0050839 | A1* | 2/2009 | Chen et al. | 252/62.58 |
| 2010/0045120 | A1* | 2/2010 | Kitano et al. | 310/44 |
| 2012/0274438 | A1* | 11/2012 | Hachiya et al. | 336/221 |
| 2013/0120097 | A1* | 5/2013 | Hachiya et al. | 336/200 |

FOREIGN PATENT DOCUMENTS

| | | | | |
|---|---|---|---|---|
| JP | 2005-85967 | | 3/2005 | |
| JP | 2005085967 | A * | 3/2005 | |
| JP | 2012-94804 | | 5/2012 | |
| JP | 2012094804 | A * | 5/2012 | |
| JP | WO 2012132565 | A1 * | 10/2012 | H01F 1/24 |

* cited by examiner

*Primary Examiner* — Tsz Chan

(74) *Attorney, Agent, or Firm* — McDermott Will & Emery LLP

(57) ABSTRACT

Disclosed herein is a metal magnetic powder, and the metal magnetic powder according to the exemplary embodiment of the present invention includes a soft magnetic core particle and a multilayer coating film covering the core particle and having a multilayer structure, the multilayer coating film including an oxide film formed by heat treating the core particle and an insulation film formed by coating a coating particle with respect to the core particle.

11 Claims, 4 Drawing Sheets

METAL MAGNETIC POWDER AND METHOD FOR FORMING THE SAME, AND INDUCTOR MANUFACTURED USING THE METAL MAGNETIC POWDER

CROSS REFERENCE(S) TO RELATED APPLICATIONS

This application claims the benefit under 35 U.S.C. Section 119 of Korean Patent Application Serial No. 10-2013-0071603, entitled "Metal Magnetic Powder and Method for Forming the Same, and Inductor Manufactured Using the Metal Magnetic Powder" filed on Jun. 21, 2013, which is hereby incorporated by reference in its entirety into this application.

BACKGROUND OF THE INVENTION

1. Technical Field

The present invention relates to a metal magnetic powder and a method for forming the same, and more particularly, to a metal magnetic powder capable of improving a direct current (DC)-bias characteristic and an inductance property of an inductor, a method for forming the same, and an inductor manufactured using the metal magnetic powder.

2. Description of the Related Art

A multilayer type power inductor is mainly used in a power supply circuit such as a direct-current (DC) to direct-current (DC) converter within a portable electronic device, and in particular, the inductor materially or structurally suppresses magnetic saturation thereof to be used at a high current. The multilayer type power inductor has a disadvantage in that a change in inductance value according to a current applied thereto is large, however, has an advantage in that it has a smaller size and a thinner thickness as compared to a wire-wound type power inductor, thereby being appropriate for the recent trend of electronic components.

The multilayer type power inductor is manufactured by multilayering magnetic sheets having internal electrodes printed thereon to manufacture a device body, and then forming external electrodes electrically connected to the internal electrodes on each surface at both ends of the device body. Here, the magnetic sheets are generally made of a composite material containing a ferrite powder. In addition, in order to decrease the change in inductance with respect to the current at an outer portion, a gap layer made of a non-magnetic material may be inserted into the device body to cut a magnetic flux.

In the above-described power inductor, a soft magnetic material having good reactivity even in a low magnetic field is used in order to implement a high inductance characteristic, wherein a ferrite powder has been used as the soft magnetic material. However, the power inductor using the soft magnetic material such as ferrite is difficult to implement excellent DC-bias characteristics due to a material limitation in a saturation magnetic flux. Therefore, technology for manufacturing a power inductor by using a metal magnetic powder having a high saturation magnetic value using the soft magnetic material has been recently developed.

However, in the case of the metal magnetic powder, a phosphate salt, or the like, which is a non magnetic insulator, is used as an insulation coat for the surface, but the thus-prepared phosphate coating film has a weak heat resistance, or the like, and can be easily destroyed in the preparation thereof, such that resistance characteristic is remarkably deteriorated by a heat treatment at a high temperature of about 500 or more, and a loss in an eddy current is increased.

RELATED ART DOCUMENT

Patent Document (Patent Document 1) Japanese Patent Laid-Open Publication No. 2005-085967

SUMMARY OF THE INVENTION

An object of the present invention is to provide a metal magnetic powder for manufacturing an inductor capable of implementing high inductance characteristic even in a high frequency, and a method for forming the same.

Another object of the present invention is to provide a metal magnetic powder for manufacturing an inductor having high resistance characteristic by improving heat resistance in manufacturing the inductor, and a method for forming the same.

Still another object of the present invention is to provide an inductor capable of improving inductance, permeability, and Q values even in a high frequency of 1 MHz or higher by using a metal having an excellent saturation magnetic value as a magnetic material.

According to a first exemplary embodiment of the present invention, there is provided a metal magnetic powder including: a core particle; and a multilayer coating film covering the core particle and having a multilayer structure, wherein the multilayer coating film includes an oxide film formed by heat treating the core particle; and an insulation film formed by coating a coating particle with respect to the core particle.

The core particle may contain an iron (Fe)-based alloy, and the oxide film may contain iron oxide.

The insulation film may include a chromium oxide film or a magnesium oxide film.

The insulation film may be formed by using a mechanofusion process in which the core particle is physicochemically combined with a core particle having a nano size.

The insulation film may locally cover the core particle, and the oxide film may cover a portion of the core particle exposed by the insulation film.

The oxide film may cover the cover particle at an inner side of the insulation film.

The insulation film may have an embossing-shaped surface.

According to a second exemplary embodiment of the present invention, there is provided a method for forming a metal magnetic powder including: preparing a core particle; and forming a multilayer coating film having a multilayer structure on the core particle, wherein the forming of the multilayer coating film includes forming an insulation film on the core particle by coating a coating particle with respect to the core particle; and forming an oxide film on a surface of the core particle by heat treating the core particle at a temperature lower than 500.

The preparing of the core particle may include preparing an iron (Fe) or iron (Fe)-based alloy powder.

The forming of the insulation film may include forming the oxide film by using a mechanofusion process in which the core particle is physicochemically combined with a core particle having a nano size.

The forming of the insulation film may include forming the oxide film having an embossing shaped surface on the core particle.

The preparing of the core particle may include preparing an iron (Fe) or iron (Fe)-based alloy powder, and the forming of the oxide film includes forming a coating film made of iron oxide on the surface of the oxide film by heat treating the core particle.

The forming of the oxide film on the surface of the core particle may include heat treating the core particle at a temperature of 350 to 450.

According to a third exemplary embodiment of the present invention, there is provided an inductor including: a device body manufactured by using a composite material containing a metal magnetic powder; an internal electrode provided in the device body; and an external electrode formed at each of both end portions of the device body so as to be electrically connected to the internal electrode at an outer portion of the device body, wherein the metal magnetic powder includes: a core particle; and a multilayer coating film covering the core particle and having a multilayer structure, and the multilayer coating film includes: an oxide film formed by heat treating the core particle; and an insulation film formed by coating a coating particle with respect to the core particle.

The core particle may contain a pure iron or iron-based alloy powder, and the oxide film may contain iron oxide.

The insulation film may be formed by coating a coating particle having a nano size with respect to the core particle by a mechanofusion process.

The oxide film may be formed by performing a steam heat treatment at a temperature of 350 to 450 with respect to the core particle.

BRIEF DESCRIPTION OF THE DRAWINGS

FIGS. 6A to 6C are views describing a process for forming the metal magnetic powder according to the exemplary embodiment of the present invention.

DESCRIPTION OF THE PREFERRED EMBODIMENTS

Figure 1:
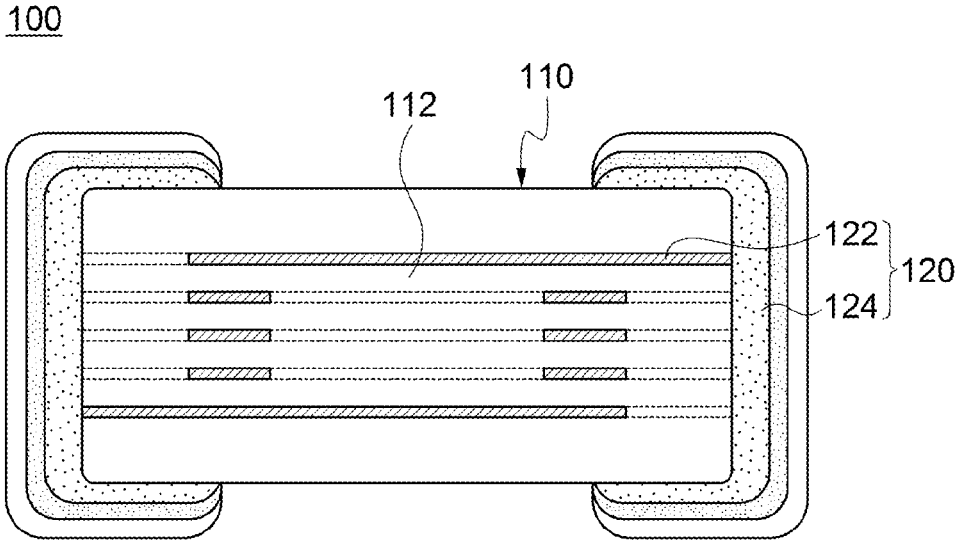
FIG. 1 is a view showing an inductor according to an exemplary embodiment of the present invention.

Various advantages and features of the present invention and methods accomplishing thereof will become apparent from the following description of exemplary embodiments with reference to the accompanying drawings. However, the present invention may be modified in many different forms and it should not be limited to the exemplary embodiments set forth herein. Rather, these exemplary embodiments may be provided so that this disclosure will be thorough and complete, and will fully convey the scope of the invention to those skilled in the art. Like reference numerals throughout the specification denote like elements.

Terms used in the present specification are for explaining the exemplary embodiments rather than limiting the present invention. Unless explicitly described to the contrary, a singular form includes a plural form in the present specification. The word "comprise" and variations such as "comprises" or "comprising," will be understood to imply the inclusion of stated constituents, steps, operations and/or elements but not the exclusion of any other constituents, steps, operations and/or elements.

In addition, exemplary embodiments in the specification of the present invention will be described with reference to cross-sectional views and/or plan views which are ideal exemplary views of the present invention. In drawings, each thickness of films and regions is exaggerated for effective explanation of technical description. That is, the exemplary views may be modified by an allowable error, or the like. Therefore, the exemplary embodiments of the present invention are not limited to a specific form which is shown but include variation according to the manufacturing process. For example, an etching region shown at a right angle may be rounded or have a predetermined curvature.

Hereinafter, a metal magnetic powder according to an exemplary embodiment of the present invention, a method for forming the same, and an inductor manufactured using the metal magnetic powder will be described in detail with reference to the accompanying drawings.

Figure 2:
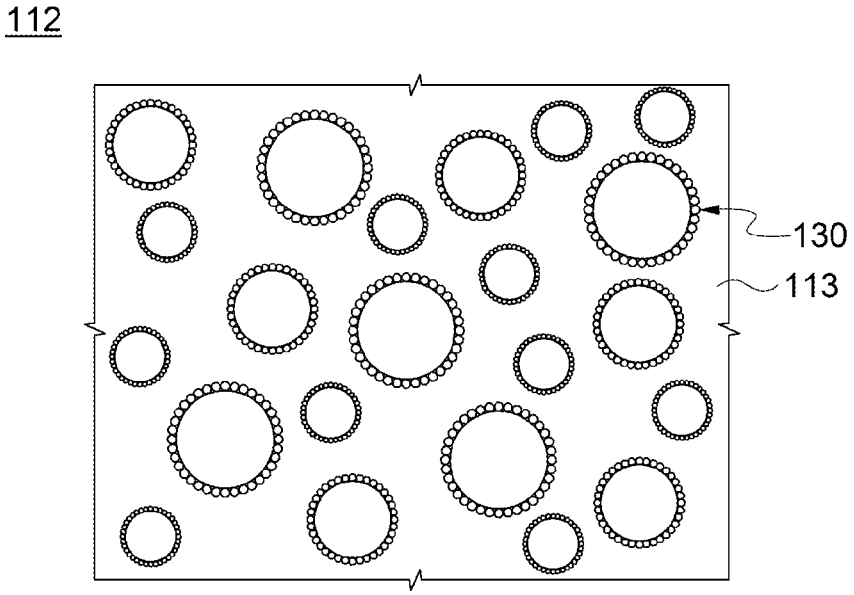
FIG. 2 is a view showing a magnetic sheet shown in FIG. 1.

FIG. 1 is a view showing an inductor according to the exemplary embodiment of the present invention, and FIG. 2 is a view showing a magnetic sheet shown in FIG. 1.

Referring to FIGS. 1 and 2, the inductor 100 according to the exemplary embodiment of the present invention, which is a multilayer type or a thin type power inductor, may provide a device body 110 and an electrode structure 120 provided in the device body 110.

The device body 110 may have a multilayer structure including a plurality of magnetic sheets 112. Each of the magnetic sheet 112 may be formed by preparing a resin-metal composite material made of a resin 113 and a metal magnetic powder 130 of FIG. 3 as a sheet. The resin 113 may be a thermosetting resin. As an example of the resin 113, the thermosetting resin which is cured at a temperature of about 300 or lower, such as an epoxy resin, a melamine resin, or the like, may be used. The magnetic sheets 112 may be applied to the inductor usable even at a high current by using the metal magnetic powder 130 having an excellent saturation magnetic value as a material of the device body 110 of the multilayer type power inductor.

The electrode structure 120 may include an internal electrode 122 and an external electrode 124. The internal electrode 122 may be formed on the magnetic sheets 112 in the device body 110. The internal electrode 122 may be a circuit pattern made of silver (Ag) or the other metal material. Here, the internal electrode 122 may be formed by using a metal paste which is capable of implementing conductivity by a low temperature firing.

The external electrode 124 may allow the inductor 100 to be electrically connected to an external electronic device (not shown). The external electrodes 124 may be electrically connected to the internal electrodes 122 and may be provided at both end portions of the device body 110, respectively. The external electrode 124 may be configured of metal layers as external terminals and plated layers made of nickel (Ni) or tin (Sn) formed by performing a plating process on the metal layer.

In the inductor 100 having the above-described structure, the metal magnetic powder 130 having high saturation magnetic value rather than an oxide-based ferrite material, is used as a magnetic material, thereby manufacturing an inductor usable at a high current. Therefore, in the inductor according to the exemplary embodiment of the present invention, the metal core particle having the high saturation magnetic value is coated with a coating film having the multilayer structure to be used as the magnetic material, thereby improving inductance characteristic and DC-bias characteristic even in a high frequency of 1 MHz or higher. In this case, since the metal magnetic powder 130 having the high saturation magnetic value is used as the magnetic material, problems such as decrease in the inductance characteristic and low direct current bias characteristic due to the magnetic saturation may be overcome, and a separate non magnetic gap layer does not have to be provided.

In addition, the metal magnetic powder used in the device body 110 of the above-described inductor 100 will be described in detail.

Figure 3:
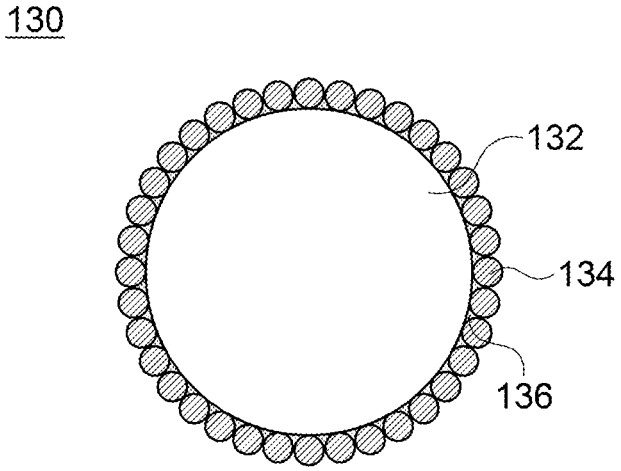
FIG. 3 is a view showing a metal magnetic powder according to an exemplary embodiment of the present invention.
Figure 4A:
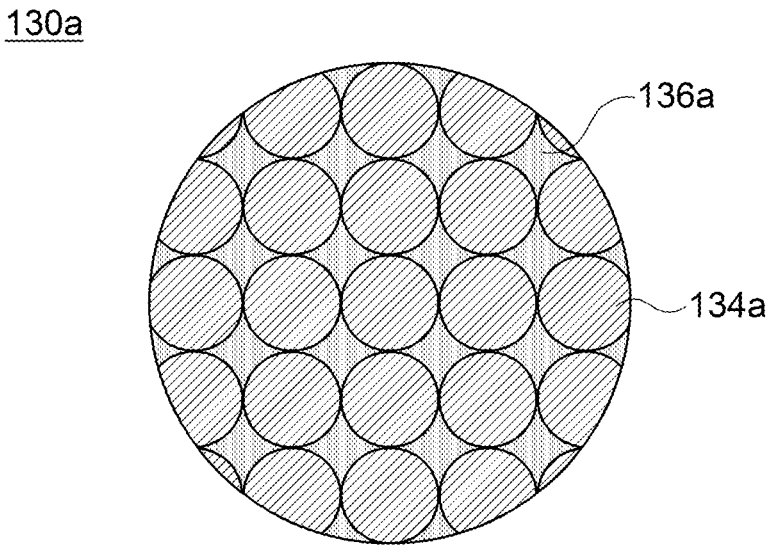
FIG. 4A is an enlarged view showing a surface of the metal magnetic powder according to the exemplary embodiment of the present invention.
Figure 4B:
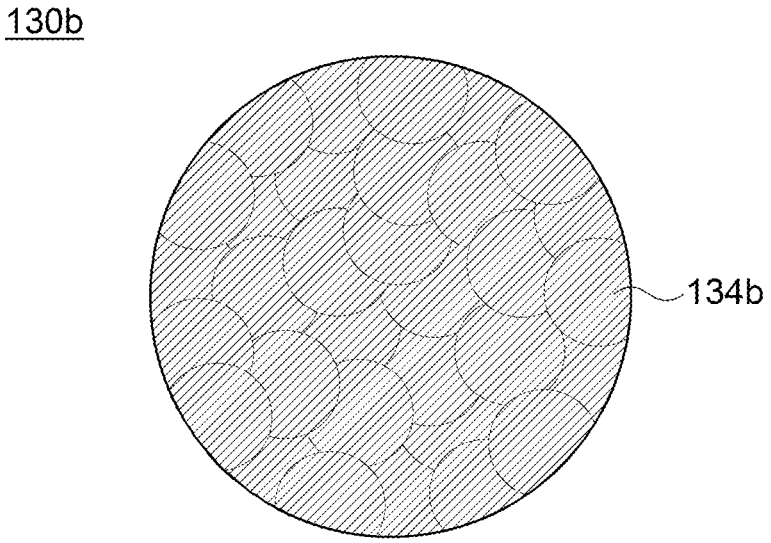
FIG. 4B is an enlarged view showing the surface of the metal magnetic powder according to another exemplary embodiment of the present invention.

FIG. 3 is a view showing a metal magnetic powder according to the exemplary embodiment of the present invention, and FIG. 4A is an enlarged view showing a surface of the metal magnetic powder according to the exemplary embodiment of the present invention. In addition, FIG. 4B is an enlarged view showing a surface of the metal magnetic powder according to another exemplary embodiment of the present invention.

Referring to FIG. 3, the metal magnetic powder 130 according to the exemplary embodiment of the present invention may have a core particle 132 in which a coating film having the multilayer structure is formed on a surface thereof. The core particle 132 may be a soft magnetic metal powder. The core particle 132 may contain pure iron or an iron (Fe)-based alloy powder. As an example of the core particle 132, pure iron containing 99 wt % or more of iron (Fe) may be used. As another example of the core particle 132, at least one alloy selected from a group consisting of Fe—Si, Fe—Al, Fe—N, Fe—C, Fe—B, Fe—Co, Fe—P, Fe—Ni—Co, Fe—Cr, Fe—Si—Al, Fe—Si—Cr, and Fe—Si—B—Cr may be included.

An insulation film 134 may be a coating film formed on the core particle 132. For example, the insulation film 134 may be a coating film in which predetermined core particles are coated on the core particle 132 by using a mechanofusion process. For example, the insulation film 134 may be formed by coating the coating particles having a nano size on the surface of the core particle 132. In the case of using the coating particle having the nano size, an oxide film may be effectively formed at a relatively low temperature lower than 500, such that the insulation film may be effectively coated even in the case in which the core particle 132 is an amorphous iron alloy Here, the insulation film 134 may be various kinds of oxide films. For example, the insulation film 134 may contain at least one oxide film selected from a group consisting of aluminum (Al), zirconium (Zr), silicon (Si), titanium (Ti), magnesium (Mg), chromium (Cr), manganese (Mn), sodium (Na), lithium (Li), zinc (Zn), barium (Ba), and cesium (Ce). An example of the insulation films 134 may be a chromium oxide film or a magnesium oxide film.

The oxide film 136 may be formed in a coating film form on the surface of the core particle 132. For example, the oxide film 136 may be a metal oxide film formed by heat treating the core particle 132. As an example of the oxide film 136, the oxide film may be formed by performing a steam heat treatment process at a temperature lower than about 500 with respect to the core particle 132. Therefore, in the case in which the core particle 132 is an iron (Fe)-based alloy powder, the oxide film 136 may be a coating film having iron oxide as a main component. For example, the oxide film 136 may be at least one of FeO, Fe2O3, and Fe3O4.

Meanwhile, the insulation film 134 and the oxide film 136 may be formed in a multilayer coating film structure on the core particle 132. For example, the oxide film 136 and the insulation film 134 may be sequentially laminated on the core particle 132, and the insulation film 134 and the oxide film 136 may have a multilayer structure on the core particle 132. The coating film having the multilayer structure may allow the core particle 132 to be effectively insulation-coated and have high close adhesion or adhesion force with respect to the core particle 132, which may not be damaged at a temperature lower than 500 or may not be easily separated from the core particle 132.

The above-described coating film having the multilayer structure may coat the core particle 132 in various shapes. As an example of the coating film 130*a* according to the exemplary embodiment of the present invention, as shown in FIG. 4A, the insulation film 134*a* may be locally formed so that a portion of the core particle is exposed, and the oxide film 136*a* may be formed in the portion selectively exposed by the insulation film 134*a* In this case, the insulation film 134*a* may be non-uniformly coated on the surface of the core particle, and have an embossing-shaped surface. As another example of the coating film 130*b* according to another exemplary embodiment of the present invention, as shown in FIG. 4B, the surface of the core particle may be covered with the oxide film, and the oxide film may be covered with the insulation film 134*b*. In this case, the surface of the core particle may be coated with the insulation film 134*b* at a relatively uniform thickness, and the oxide film may be coated by being surrounded by the insulation film 134*b*.

The metal magnetic powder 130 as described above may have a structure in which the coating film having the multilayer structure is formed on the surface of the core particle 132, wherein the coating film includes the coating particle which is configured of the insulation film 134 such as a chromium oxide film formed by using a mechanofusion process and the oxide film 136 formed by a heat treatment, thereby implementing high insulation characteristics and permeability, and high Q value. The coating film having the multilayer structure may be effective even in the amorphous iron alloy having a relatively difficulty in forming the coating film, thereby significantly improving the characteristics of the magnetic components such as a power inductor using the above-described metal magnetic powder 130. Therefore, the metal magnetic powder according to the exemplary embodiment of the present invention may have a structure in which the metal core particle having high saturation magnetic value is coated with the coating film having the multilayer structure, thereby significantly improving the insulation characteristics, permeability, and Q value of the magnetic component such as the inductor manufactured by using the metal magnetic powder.

In addition, a method for forming the metal magnetic powder 130 according to the exemplary embodiment of the present invention as described above will be described in detail. Here, an overlapped description with the above-described metal magnetic powder 130 with reference to FIGS. 1 and 4B may be omitted or simplified.

Figure 5:
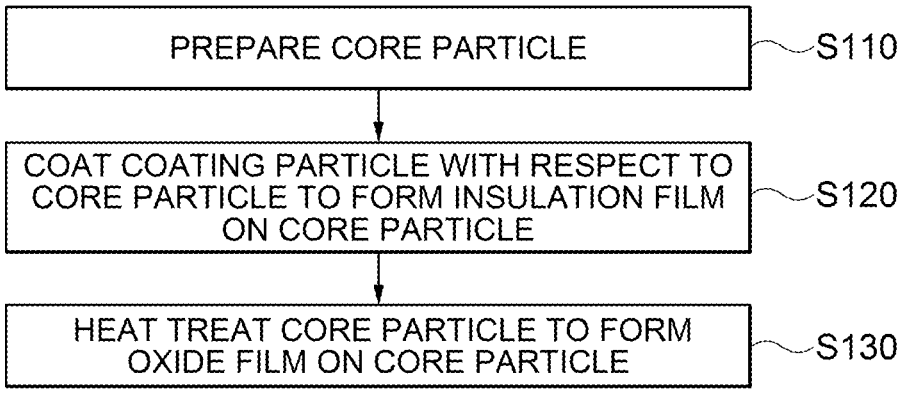
FIG. 5 is a flow chart showing a method for forming the metal magnetic powder according to the exemplary embodiment of the present invention.
Figure 5:
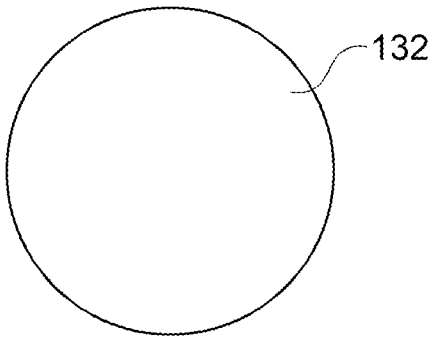
Figure 6B:
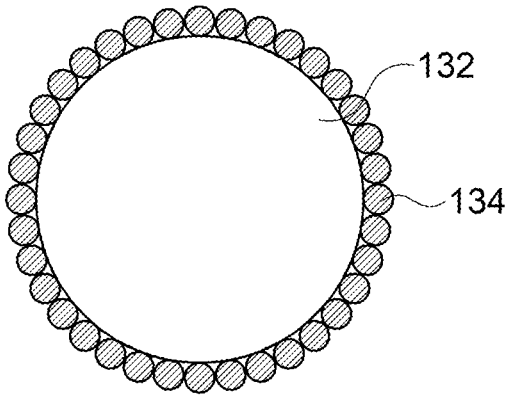
Figure 6C:
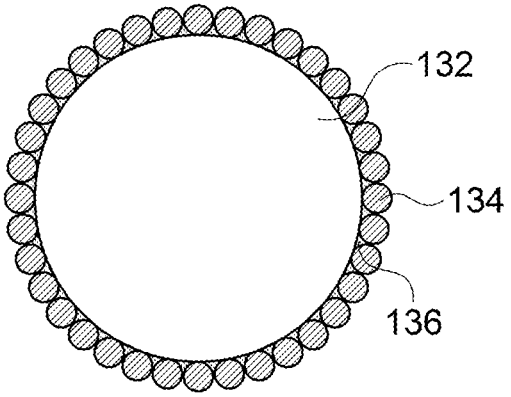

FIG. 5 is a flow chart showing a method for forming the metal magnetic powder according to the exemplary embodiment of the present invention; and FIGS. 6A to 6C are views describing a process for forming the metal magnetic powder according to the exemplary embodiment of the present invention.

Referring to FIGS. 5 and 6A, the core particle 132 may be prepared (S110). The core particle 132 may be synthesized by various processes such as an atomize process, a casting pulverization process, a reduction process, and a mechanical alloy process, or the like. Here, as the core particle 132, pure iron or an iron (Fe)-based alloy powder may be used. As an example of the core particle 132, pure iron containing 99 wt % or more of iron (Fe) may be used. As another example of the core particle 132, at least one alloy selected from a group consisting of Fe—Si, Fe—Al, Fe—N, Fe—C, Fe—B, Fe—Co, Fe—P, Fe—Ni—Co, Fe—Cr, Fe—Si—Al, Fe—Si—Cr, and Fe—Si—B—Cr may be used.

Referring to FIGS. 5 and 6B, the core particle 132 may be coated with the coating particle to form the insulation film 134 on the core particle 132 (S120). The forming of the insulation film 134 may include coating predetermined coating particles by a mechanofusion process with respect to the core particle 132, and heat treating the core particle 132 coated with the coating particles. The mechanofusion process may be a technology for forming a coating film by physicochemically combining the coating particles with each other with respect to a subject matter to be deposited. Therefore, after a mixture of the core particle 132 and the coating particles are put into a rotational container, the mixture is physicochemically combined by centrifugal force, such that the coating particles may be coated on the surface of the core particle 132. The coating particles may be various kinds of metal particles. As an example of the coating particles, the coating particle may be a chromium particle or a magnesium particle. Therefore, the insulation films 134 such as the chromium oxide film or the magnesium oxide film may be formed on the surface of the core particle 132.

Here, it is preferred that the coating particle has a nano size. For example, in the case in which a chromium nano powder or a magnesium nano powder is used for the coating particles, the oxide film may be effectively formed even at a relatively low temperature lower than 500. In particular, in the case in which the coating particles having the nano size are used to form a coating film by the mechanofusion process, the coating film may be effectively coated even in the case in which a subject matter to be coated is an amorphous iron alloy.

In addition, a heat treatment may be performed on the core particle 132. For example, in the heat treatment, the coating film coated on the surface of the core particle 132 by using the mechanofusion process may be heat treated at a predetermined oxidation atmosphere, and the coating particles coated on the surface of the core particle 132 may be oxidized. Here, since the coating particles have a nano size, the oxide film may be easily formed on the surface of the core particle 132 even at a relatively low temperature. In addition, in the case in which the coating particles have the nano size, the core particle 132 may be effectively coated even in the amorphous iron alloy which is relatively difficult to form the coating film.

Meanwhile, the above-described insulation film 134 may have a non-uniform surface. More specifically, the insulation film 134 may have an embossed shaped surface. To this end, conditions of the mechanofusion process may be variously controlled. As an example thereof, the coating particles may be atypically and locally coated on the insulation film 134. In this case, the insulation film 134 may be locally formed so that a portion of the surface of the core particle 132 is exposed.

Referring to FIGS. 5 and 6C, the core particle 132 may be heat treated to form the oxide film 136 on the surface of the core particle 132 (S130). In the forming of the oxide film 136, a steam heat treatment may be performed at a temperature of about 350 to 450 with respect to the core particle 132, such that the surface of the core particle 132 may be oxidized. Therefore, in the case in which the core particle 132 is pure iron or an iron (Fe)-based alloy, the oxide film 136 may be iron oxide. Therefore, the metal magnetic powder 130 configuring the coating film having the multilayer structure and including the insulation film 134 and the oxide film 136 may be formed on the surface of the core particle 132.

Meanwhile, the oxide film 136, which is a metal oxide film formed by oxidizing the core particle 132, may be relatively directly formed on the surface of the core particle 132 as compared to the insulation film 134. Therefore, the surface of the core particle 132 may be directly covered with the oxide film 136 and the oxide film 136 may be covered with the insulation film 134, on the core particle 132. In this case, the oxide film 136 together with the previously formed insulation film 134 may be formed in the coating film having the multilayer structure on the core particle 132. In the above-described coating film having the multilayer structure, the adhesion force and the close adhesion of the insulation film 134 are improved on the surface of the core particle 132, such that the insulation film 134 may not be easily damaged.

As described above, in the method for forming the metal magnetic powder 130 according to the exemplary embodiment of the present invention, after the insulation film 134 is formed on the core particle 132 by the mechanofusion process, the core particle 132 is heat treated at a low temperature lower than 500 to form the oxide film 136 on the surface of the core particle 132, thereby forming the core particle 132 coated in the coating film having the multilayer structure including the insulation film 134 and the oxide film 136. The metal magnetic powder 130 formed by the above-described processes may have high insulation characteristics, permeability, and high Q value. Therefore, the method for forming the metal magnetic powder according to the present invention may effectively form the insulation coating film having the multilayer structure even in the amorphous iron alloy which is relatively difficult to form the coating film, thereby forming the metal magnetic powder capable of significantly improving the characteristics of the magnetic components such as the power inductor using the soft magnetic core particle as the magnetic material.

As set forth above, the metal magnetic powder according to the exemplary embodiment of the present invention may have a structure in which the metal core particles having the high saturation magnetic value are coated with a coating film having a multilayer structure, thereby significantly improving the insulation characteristics, the permeability, and the Q value of the magnetic component such as the inductor manufactured using the metal magnetic powder.

In addition, with the method for forming the metal magnetic powder according to the exemplary embodiment of the present invention, the insulation coating film having the multilayer structure may be effectively formed even in the amorphous iron alloy which is relatively difficult to form the coating film, thereby forming the metal magnetic powder capable of significantly improving the characteristics of the magnetic components such as the power inductor using the soft magnetic core particle as the magnetic material.

Further, with the inductor according to the exemplary embodiment of the present invention, the metal core particle having the high saturation magnetic value may be coated with the coating film having the multilayer structure to be used as the magnetic material, thereby improving the inductance characteristic and the DC-bias characteristic even in the high frequency of 1 MHz or higher.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. Accordingly, such modifications, additions and substitutions should also be understood to fall within the scope of the present invention.

What is claimed is:

1. A metal magnetic powder comprising:

a core particle being an amorphous iron alloy; and a multilayer coating film covering the core particle and having a multilayer structure, wherein the multilayer coating film includes an oxide film and an insulation film having a coating particle selected from chromium oxide or magnesium oxide, wherein the oxide film is iron oxide originating from the core particle, wherein the coating particle in the insulation film has a grain boundary separated from that of an adjacent coating particle, and wherein the coating particle in the insulation film is locally disposed on the surface of the core particle so that a portion of the surface of the core particle is exposed, and the oxide film is disposed on the exposed portion of the surface of the core particle.

2. The metal magnetic powder according to claim 1, wherein the core particle contains an iron (Fe)-based alloy, and the oxide film contains iron oxide.

3. The metal magnetic powder according to claim 1, wherein the insulation film includes a chromium oxide film or a magnesium oxide film.

4. The metal magnetic powder according to claim 1, wherein the insulation film is formed by using a mechanofusion process in which the core particle is physicochemically combined with a core particle having a nano size.

5. The metal magnetic powder according to claim 1, wherein the insulation film locally covers the core particle, and the oxide film covers a portion of the core particle exposed by the insulation film.

6. The metal magnetic powder according to claim 1, wherein the oxide film covers the cover particle at an inner side of the insulation film.

7. The metal magnetic powder according to claim 1, wherein the insulation film has an embossing-shaped surface.

8. An inductor comprising:

a device body manufactured by using a composite material containing a metal magnetic powder;

an internal electrode provided in the device body; and an external electrode formed at each of both end portions of the device body so as to be electrically connected to the internal electrode at an outer portion of the device body, wherein the metal magnetic powder includes:

a core particle being an amorphous iron alloy; and a multilayer coating film covering the core particle and having a multilayer structure, wherein the multilayer coating film includes an oxide film and an insulation film having a coating particle selected from chromium oxide or magnesium oxide, wherein the oxide film is iron oxide originating from the core particle, wherein the coating particle in the insulation film has a grain boundary separated from that of an adjacent coating particle, and wherein the coating particle in the insulation film is locally disposed on the surface of the core particle so that a portion of the surface of the core particle is exposed, and the oxide film is disposed on the exposed portion of the surface of the core particle.

9. The inductor according to claim 8, wherein the core particle contains a pure iron or iron-based alloy powder, and the oxide film contains iron oxide.

10. The inductor according to claim 8, wherein the insulation film is formed by coating a coating particle having a nano size with respect to the core particle by a mechanofusion process.

11. The inductor according to claim 8, wherein the oxide film is formed by performing a steam heat treatment at a temperature of 350 to 450 with respect to the core particle.

* * * * *